US009820030B2

(12) United States Patent
Liu et al.

(10) Patent No.: US 9,820,030 B2
(45) Date of Patent: Nov. 14, 2017

(54) HEADSET JACK AND METHOD FOR DETECTING WHETHER HEADSET IS INSERTED IN POSITION

(71) Applicant: Huawei Technologies Co., Ltd., Shenzhen (CN)

(72) Inventors: Haodong Liu, Shanghai (CN); Wei Mei, Shanghai (CN); Shunji Zhu, Shanghai (CN)

(73) Assignee: Huawei Technologies Co., Ltd, Shenzhen (CN)

( * ) Notice: Subject to any disclaimer, the term of this patent is extended or adjusted under 35 U.S.C. 154(b) by 0 days.

(21) Appl. No.: 15/214,010

(22) Filed: Jul. 19, 2016

(65) Prior Publication Data

US 2016/0330539 A1 Nov. 10, 2016

Related U.S. Application Data

(63) Continuation of application No. PCT/CN2015/092102, filed on Oct. 16, 2015.

(30) Foreign Application Priority Data

Apr. 15, 2015 (CN) ..... 2015 1 0179295

(51) Int. Cl.
*H04R 1/10* (2006.01)

(52) U.S. Cl.
CPC ..... *H04R 1/1041* (2013.01); *H04R 2420/05* (2013.01)

(58) Field of Classification Search
CPC H04R 1/1041; H04R 2420/05; H04R 13/703; H04R 24/58; H04R 2420/09; H04M 1/6058
USPC ..... 381/74, 370, 375, 384; 439/344, 663, 439/669
See application file for complete search history.

(56) References Cited

U.S. PATENT DOCUMENTS

2009/0296952 A1* 12/2009 Pantfoerder ..... H04M 1/6058 381/74
2011/0170734 A1* 7/2011 Lim ..... H04R 1/1041 381/384
2013/0116014 A1* 5/2013 Johnson ..... H04R 1/1041 455/569.1

(Continued)

FOREIGN PATENT DOCUMENTS

CN 101308187 A 11/2008
CN 201498827 U 6/2010

(Continued)

*Primary Examiner* — Melur Ramakrishnaiah
(74) *Attorney, Agent, or Firm* — Slater Matsil, LLP

(57) ABSTRACT

A headset jack includes a side wall, a bottom part, a clamping component on the side wall, a first detection end at the bottom part, a second detection end on the side wall or at the bottom part, and a membrane switch electrically connected to the second detection end. The clamping component is configured to clamp a headset plug when the headset plug is inserted into the headset jack. When the headset plug is not inserted in position, the membrane switch is electrically isolated from the first detection end. The membrane switch is configured to generate elastic deformation under a pressure of the headset plug when the headset plug is inserted in position and be electrically connected to the first detection end.

9 Claims, 4 Drawing Sheets

(56) References Cited

U.S. PATENT DOCUMENTS

| | | | |
|---|---|---|---|
| 2013/0148820 | A1 | 6/2013 | Sagong et al. |
| 2016/0330539 | A1 | 11/2016 | Liu et al. |

FOREIGN PATENT DOCUMENTS

| | | | |
|---|---|---|---|
| CN | 103022831 | A | 4/2013 |
| CN | 103167392 | A | 6/2013 |
| CN | 103904488 | A | 7/2014 |
| CN | 104918154 | A | 9/2015 |
| EP | 2605498 | A1 | 6/2013 |

* cited by examiner

HEADSET JACK AND METHOD FOR DETECTING WHETHER HEADSET IS INSERTED IN POSITION

CROSS-REFERENCE TO RELATED APPLICATIONS

This application is a continuation of International Application No. PCT/CN2015/092102, filed on Oct. 16, 2015, which claims priority to Chinese Patent Application No. 201510179295.8, filed on Apr. 15, 2015, both of which are hereby incorporated by reference in their entireties.

TECHNICAL FIELD

The present disclosure relates to the field of electronic technologies, and in particular embodiments, to a headset jack and a method for detecting whether a headset is inserted in position.

BACKGROUND

In an existing portable electronic device such as a mobile phone, a tablet computer, or a media player, the device needs to learn an insertion status of a headset, namely, whether the headset is inserted into the portable electronic device and whether the headset is half inserted or fully inserted. After the portable electronic device learns the insertion status of the headset, the portable electronic device may perform a corresponding operation. For example, after learning that the headset is inserted, the device starts to turn on an interface between media player software and headset driver software. In a typical application scenario, headset insertion detection is performed by a circuit in the portable electronic device.

Because a headset plug part is generally metallic, when a headset plug is inserted into a headset jack, namely, a headset hole, of the portable electronic device, whether the headset plug is inserted into the headset jack is detected by means of voltage change between two contacts (or pins), namely, DET and L, on the headset jack. A simplified headset jack structure is shown in FIG. 1. Both the DET contact and the L contact are capable of elastic deformation and available for detecting whether a headset is inserted. In addition, the L contact may also be used by the portable electronic device to transmit an audio-left channel signal to the headset. Other contacts also exist in the headset jack. For example, an R contact is used by the portable electronic device to transmit an audio-right channel signal to the headset, a GND contact is used for grounding, and M is used to transmit a sound generated by the headset, namely, a microphone signal, to the portable electronic device. Electronic connection may not exist between the two contacts DET and L of the headset jack before the headset is inserted. Once the headset plug is inserted into the headset jack, the DET contact is short-circuited, namely, electrically connected, to the L contact. In this case, a voltage at the DET contact changes, and a circuit electrically connected to the DET contact can identify the change of the voltage and send a notification signal to bottom-layer driver software in the portable electronic device, so that the software performs a corresponding operation to enable the portable electronic device to use the headset normally.

In another solution in the prior art, a DET contact may keep short-circuited to an L contact on a headset jack when no headset is inserted, and the DET contact may become open-circuited with the L contact after a headset is inserted. That is, insertion of the headset leads to electrical disconnection. In this case, an electrical characteristic of the DET contact also changes, and therefore, a circuit connected to the DET contact may also generate a notification signal based on the voltage change.

Due to a design of an existing headset jack, when a headset plug is half inserted, an electrical connection relationship between the DET contact and the L contact already changes. Although the headset is not inserted fully in this case, namely, is not inserted in position, which may lead to poor contact of several contacts (or pins) such as R, GND, or M, and make the headset plug unable to suit the headset jack properly, thereby leading to an exception condition. In this case, software of a portable electronic device may need to use a more sophisticated voltage threshold detection solution to further determine whether the headset is inserted in position currently, namely, determine whether the headset plug is fully inserted into the headset jack.

A typical existing solution to detecting whether the headset is inserted in position is to detect a voltage division relationship in a detection circuit in different insertion statuses. However, existing headsets come in many types. Common headsets come in three types: a tip-ring-sleeve headset, a US-standard headset (LRGM), and an international standard headset (LRMG). Different headset plugs have different impedance, which causes that structures of headset jacks may be not consistent completely and causes a quite complicated status of connection between the headset plug and the headset jack in an insertion process, and therefore causes many different values in the voltage division relationship of the DET contact. Therefore, complicated circuit hardware design and software state machine design are required in the existing solution to determining, by detecting the voltage division relationship in the circuit, whether the headset is inserted in position, which increases product implementation costs.

SUMMARY

Embodiments of the present invention provide a headset jack and a method for detecting whether a headset is inserted in position, so as to reduce complexity of an existing solution to detecting whether the headset is inserted in position.

According to a first aspect, an embodiment of the present invention provides a headset jack, including: a side wall, a bottom part, a clamping component on the side wall, a first detection end at the bottom part, a second detection end on the side wall or at the bottom part, and a membrane switch electrically connected to the second detection end, where the clamping component is configured to clamp a headset plug when the headset plug is inserted into the headset jack; when the headset plug is not inserted in position, the membrane switch is electrically isolated from the first detection end, and an electrical characteristic between the first detection end and the second detection end is a first electrical characteristic; the membrane switch is configured to: when the headset plug is inserted in position, generate elastic deformation under a pressure of the headset plug, and be electrically connected to the first detection end, so as to electrically connect the first detection end to the second detection end and change the electrical characteristic between the first detection end and the second detection end to a second electrical characteristic, where the second electrical characteristic is used to generate an electrical signal to reflect that the headset plug is inserted in position in the headset jack.

In an implementation of the first aspect, the membrane switch includes an elastically deformable conducting layer and an insulation layer that coats the conducting layer. The conducting layer is electrically connected to the second detection end, and when the headset plug is inserted in position, generates elastic deformation under the pressure of the headset plug, and is electrically connected to the first detection end; and the insulation layer is configured to electrically isolate the conducting layer from the headset plug.

In an implementation of the first aspect, the conducting layer is a metal layer.

In an implementation of the first aspect, the membrane switch includes an elastically deformable part and a conductive connector, where the conductive connector is electrically connected to the second detection end; and the elastically deformable part generates elastic deformation under the pressure of the headset plug, so as to cause the conductive connector to be electrically connected to the first detection end.

In an implementation of the first aspect, the elastically deformable part is made of an insulation material.

In an implementation of the first aspect, the elastically deformable part is made of a conductive material; and the membrane switch further includes an insulation layer that coats the elastically deformable part, where the insulation layer is configured to electrically isolate the elastically deformable part from the headset plug.

In an implementation of the first aspect, the clamping component includes multiple elastic elements configured to clamp the headset plug.

In an implementation of the first aspect, the clamping component is further configured to transmit a signal from the headset jack to the headset plug.

In an implementation of the first aspect, the signal is any one of the following: an audio-left channel signal and an audio-right channel signal.

In an implementation of the first aspect, the first electrical characteristic is electrical isolation, and the second electrical characteristic is electrical connection.

According to a second aspect, an embodiment of the present invention further provides a portable electronic device, including the headset jack disclosed in the first aspect, and a detection circuit, where the detection circuit is configured to detect the electrical signal to identify that the headset plug is inserted into the headset jack in position.

In an implementation of the second aspect, the electronic device is a portable electronic device.

According to a third aspect, an embodiment of the present invention further provides a method for detecting whether a headset is inserted in position, including: when a headset plug is inserted into the headset jack, using a clamping component on a side wall of the headset jack to clamp the headset plug, where when the headset plug is not inserted in position, a membrane switch in the headset jack is electrically connected to only a second detection end on the side wall or at a bottom of the headset jack, and avoids electrical connection to a first detection end at the bottom of the headset jack, and an electrical characteristic between the first detection end and the second detection end is a first electrical characteristic; and when the headset plug is inserted in position, the membrane switch is configured to generate elastic deformation under a pressure of the headset plug, and be electrically connected to the first detection end, so as to electrically connect the first detection end to the second detection end, and change the electrical characteristic between the first detection end and the second detection end to a second electrical characteristic, where the second electrical characteristic is used to generate an electrical signal to reflect that the headset plug is inserted in position in the headset jack.

Embodiments of the present invention provide a headset jack and a method for detecting whether a headset is inserted in position. A elastically deformable membrane switch is disposed in the headset jack to connect different detection ends and change an electrical characteristic between different detection ends, so as to generate an electrical signal for reflecting that the headset plug is inserted in position, and fulfill detecting that the headset plug is inserted in position. In the technical solutions provided in the embodiments, a mechanically structured switch is used to implement detection, use of a complicated voltage-division relationship detection circuit or detection software is avoided; the technical solutions are simple to implement, and implementation costs are reduced.

BRIEF DESCRIPTION OF THE DRAWINGS

To describe the technical solutions in the embodiments of the present invention or in the prior art more clearly, the following briefly describes the accompanying drawings required for describing the embodiments or the prior art. Apparently, the accompanying drawings in the following description show merely some embodiments of the present invention or the prior art, and a person of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present disclosure.

Figure 1:
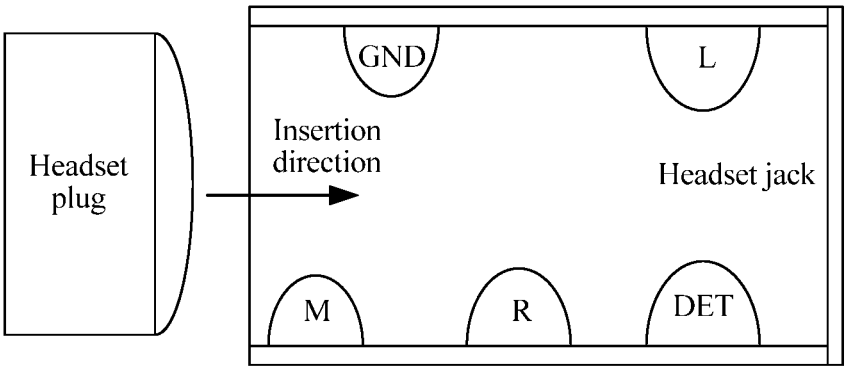
FIG. 1 is a schematic diagram of a simplified structure of a headset jack according to the prior art.
Figure 2:
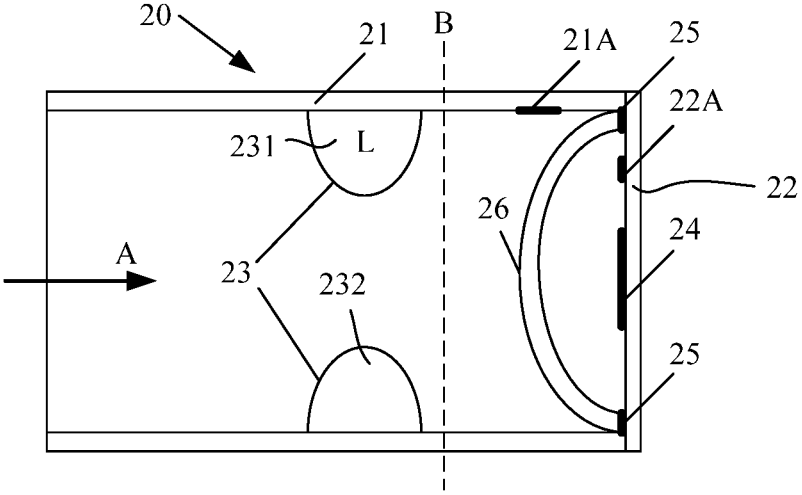
FIG. 2 is a schematic diagram of a simplified structure of a headset jack according to an embodiment of the present invention.

FIG. 2 is a simplified schematic structural diagram of a headset jack 20 according to an embodiment of the present invention. The headset jack 20 includes: a side wall 21, a bottom part 22, a clamping component 23 on the side wall 21, a first detection end 24 at the bottom part 22, a second detection end 25 on the side wall 21 or at the bottom part 22, and a membrane switch 26 electrically connected to the second detection end 25. In FIG. 2, the second detection end 25 is located at a joint between the side wall 21 and the bottom part 22. Understandably, the second detection end 25 may also be located at 21A on the side wall 21 or at 22A at the bottom part 22 in FIG. 2. Therefore, FIG. 2 or the foregoing embodiment shall not be regarded as a limitation on the protection scope of the present disclosure.

In FIG. 2, a headset plug may be inserted into the headset jack 20 along a direction of an arrow A. For a specific process of detecting whether the headset plug is inserted in position, reference may be made to FIG. 8. In S81, when the headset plug is inserted along a direction A, the clamping component 23 can clamp the headset plug. As shown in FIG. 2, the clamping component 23 may include a first elastomer 231 and a second elastomer 232 that are separated from each other. The two elastic elements 231 and 232 clamp the headset plug jointly to ensure that the headset plug is not easily detachable after being inserted into the headset jack 20. Alternatively, apart from the two elastic elements 231 and 232 in FIG. 2, the clamping component 23 may further include more other elastic elements, which are configured to better clamp the inserted headset plug. Therefore, a quantity of the elastic elements included by the clamping component 23 may be set by a person skilled in the art according to a using requirement.

Figure 3:
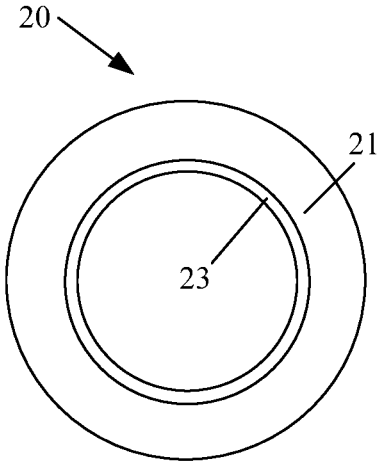
FIG. 3 is a schematic diagram of a simplified structure of a headset jack seen along a headset insertion direction according to an embodiment of the present invention.

In another embodiment of the present invention, the clamping component 23 may also be an entirety rather than multiple elastic elements included. For example, using an example in which the headset jack 20 and the headset plug are circular, if the headset jack 20 is truncated along a dashed line B in FIG. 2, a view seen along an insertion direction A of the headset may be shown in FIG. 3. The clamping component 23 surrounds the side wall 21 of the headset jack 20 by one circle, so as to clamp the headset plug. That is, in this case, the clamping component 23 is an annular elastomer. Regardless of a structure of the clamping component 23, one or more elastic elements included in the clamping component 23 are elastically deformable in a process of inserting the headset plug, and can clamp the headset plug under a tension effect of the clamping component 23 to fix the headset plug. Understandably, a jack shape of the headset jack may be not only a circular shape, but also another shape such as a rectangular or triangular shape. FIG. 3 of this embodiment does not constitute a limitation on the protection scope of the present disclosure.

When the headset plug is inserted into the headset jack 20, two circumstances exist. In a first circumstance, the headset plug is not fully inserted, namely, the headset plug does not reach the bottom part 22 of the headset jack 20. That is, the insertion is not in position. The insertion is full insertion only when the headset plug reaches the bottom part 22. That is, the insertion is in position.

Figure 8:
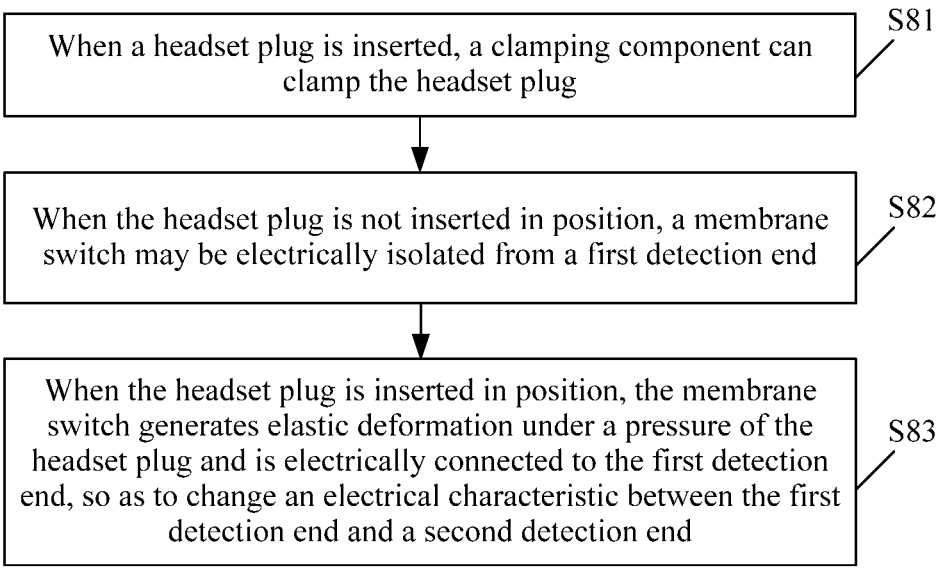
FIG. 8 is a simplified schematic flowchart of a method for detecting whether a headset is inserted in position according to an embodiment of the present invention.

For details, refer to S82 in the detection method in FIG. 8. When the headset plug is not inserted in position, a relationship between the membrane switch 26 and the first detection end 24 is shown in FIG. 2, which can avoid electrical connection. That is, in this case, the membrane switch 26 is electrically isolated from the first detection end 24. In this case, an electrical characteristic between the first detection end 24 and the second detection end 25 is a first electrical characteristic. The first electrical characteristic may be electrical disconnection, namely, electrical isolation. The first detection end 24 and the second detection end 25 are two ends of detection, and the detection ends 24 and 25 are generally metal ends, namely, two metal pins. When no headset plug is inserted, the membrane switch 26 is electrically connected to only the second detection end 25, and is not electrically connected to the first detection end 24. Therefore, the first detection end 24 is open-circuited with the second detection end 25.

Figure 4:
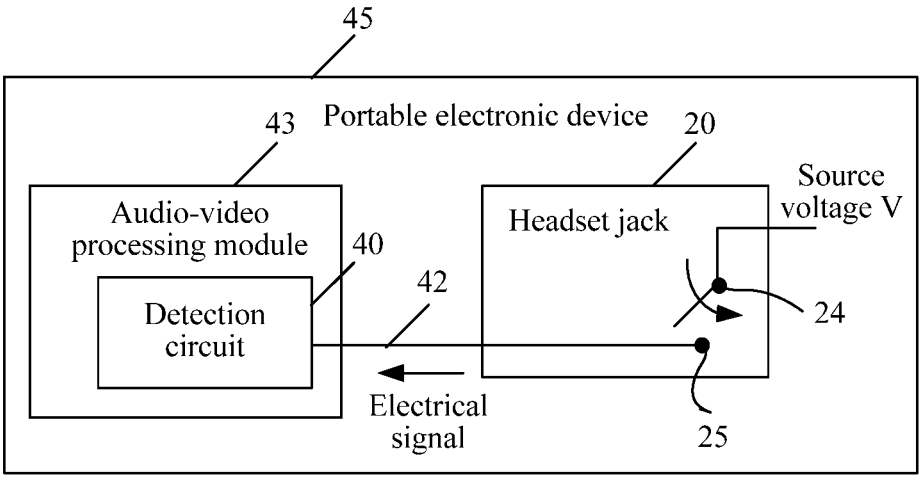
FIG. 4 is a schematic diagram of a simplified system for detecting whether a headset is inserted in position according to an embodiment of the present invention.

In S83, when the headset plug is inserted in position, the membrane switch 26 generates elastic deformation (not shown in the diagram) along the direction A under a pressure of the headset plug and is electrically connected to the first detection end 24. By using the membrane switch 26, the first detection end 24 is electrically connected to the second detection end 25 as connected by the membrane switch 26, and the electrical characteristic between the first detection end 24 and the second detection end 25 changes to a second electrical characteristic. Opposite to the first electrical characteristic that is electrical isolation, the second electrical characteristic may be electrical connection. As shown in FIG. 4, in a schematic diagram of a system provided in an embodiment of the present invention, the first detection end 24 and the second detection end 25 in the headset jack 20 are electrically connected after the headset plug is inserted, so as to connect to the first detection end 24 and/or so that the second detection end 25 is connected to a detection circuit 40. The detection circuit 40 can easily detect an electrical signal generated due to a change of an electrical connection relationship between the first detection end 24 and the second detection end 25, where the electrical signal can reflect that the headset plug is inserted in position in the headset jack. Specifically in FIG. 4, after the first detection end 24 is electrically connected to the second detection end 25, a source voltage V may be connected to the detection circuit 40 by using a signal wire 42. The detection circuit 40 receives, by using the signal wire 42, the electrical signal that reflects a value of the source voltage V, so as to detect the electrical signal to identify that the headset plug is inserted in position. Optionally, the source voltage V may be a 1.8 volt (V) voltage, and therefore, the electrical signal is a voltage signal whose value is 1.8 V, and is detected by the detection circuit 40. In this case, the detection circuit 40 may be a voltage detection circuit.

As shown in FIG. 4, the detection circuit 40 in this embodiment of the present invention may be located in an audio-video processing module 43. The audio-video processing module 43 may be a chip or a function unit in a chip. The headset jack 20 and the audio-video processing module 43 that includes the detection circuit 40 may be located in a portable electronic device 45. The portable electronic device 45 may be a mobile phone, a media player, a tablet computer, or the like. Certainly, the solution is not only applicable to a portable electronic device, but also applicable to other various electronic devices, including a server, a fixed station, and the like.

Figure 5:
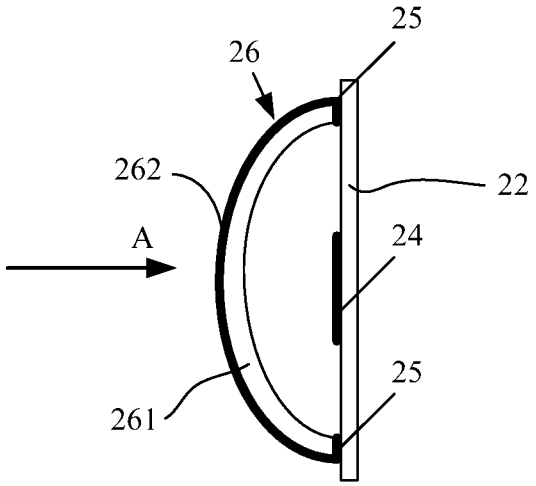
FIG. 5 is a schematic diagram of a simplified structure of a membrane switch according to an embodiment of the present invention.

As shown in FIG. 5, in an optional implementation, the membrane switch 26 includes an elastically deformable conducting layer 261 and an insulation layer 262 that coats the conducting layer; the conducting layer 261 is electrically connected to the second detection end 25, and when the headset plug is inserted in position, generates elastic deformation along the direction A under the pressure of the headset plug and is electrically connected to the first detection end 24. By using the conducting layer 261, the first detection end 24 is electrically connected to the second detection end 25. The insulation layer 262 is configured to electrically isolate the conducting layer 261 from the headset plug, so that a conductive part of the headset plug is prevented from directly contacting the conducting layer 261 configured to implement detection of in-position insertion, thereby avoiding introducing noise to the headset. Generally, the conducting layer 261 is a metal layer, such as an aluminum layer.

Figure 6:
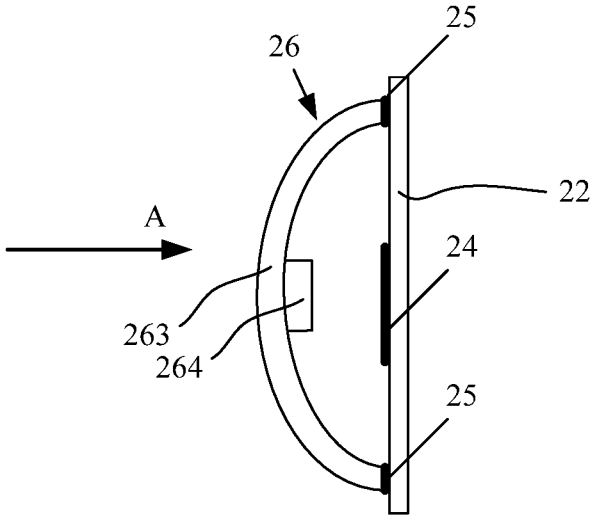
FIG. 6 is a schematic diagram of another simplified structure of a membrane switch according to an embodiment of the present invention.

As shown in FIG. 6, in another optional implementation, the membrane switch 26 includes an elastically deformable part 263 and a conductive connector 264. The conductive connector 264 is generally a metallic conductive connection component, and the conductive connector 264 may be electrically connected to the second detection end 25 by using a conducting wire or by other means. The elastically deformable part 263 generates elastic deformation along the direction A under the pressure of the headset plug, so as to cause the conductive connector 264 to be electrically connected to the first detection end 24. After the elastic deformation occurs, the first detection end 24 is electrically connected to the second detection end 25 by using the conductive connector 264. The elastically deformable part 263 may be made of an insulation material to electrically isolate the headset plug from the conductive connector 264, and prevent the conductive connector 264 from introducing noise to the headset plug. When the elastically deformable part 263 is made of an insulation material, the conducting wire or another electrical connection component configured to connect the conductive connector 264 and the second detection end 25 may be buried in the elastically deformable part 263, or may be affixed to a surface of the elastically deformable part 263.

Figure 7:
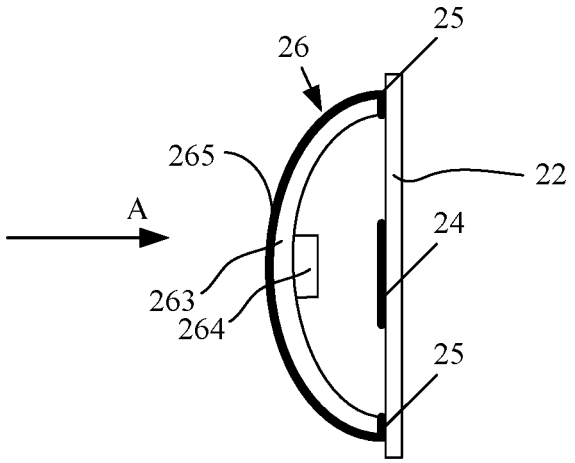
FIG. 7 is a schematic diagram of another simplified structure of a membrane switch according to an embodiment of the present invention.

Alternatively, in another optional implementation, the elastically deformable part 263 shown in FIG. 6 may also be made of a conductive material, such as metal. In this case, as shown in FIG. 7, the membrane switch 26 may further include an insulation layer 265 that coats the elastically deformable part 263, where the insulation layer 265 is configured to electrically isolate the elastically deformable part 263 from the headset plug and avoid introducing of noise. In this case, because the elastically deformable part 263 is a conductor, which may be configured to connect the conductive connector 264 and the second detection end 25. Therefore, the additional conducting wire or another electrical connection component configured to connect the conductive connector 264 and the second detection end 25 may be omitted.

In the present disclosure, the first detection end 24 is selectively connected to the second detection end 25 by disposing the first detection end 24, which is configured to detect whether the headset plug is inserted in position, at the bottom part 22 of the headset jack 20 and by disposing the elastically deformable membrane switch 26, so as to change the electrical characteristic between the first detection end 24 and the second detection end 25. The electrical signal generated by the change of the electrical characteristic can be detected by the detection circuit 40 conveniently. In this solution, a relatively good detection effect is implemented by using a simple mechanical structure, use of a complicated voltage-division relationship detection circuit or detection software is avoided; the technical solution is simple to implement, and product implementation costs are reduced.

It should be noted that in this embodiment of the present invention, the changed electrical characteristic may be not only electrical connection or electrical disconnection (namely, electrical isolation), but may also be another electrical characteristic, such as voltage change or resistance value change. For example, a fixed resistance value may exist between the first detection end 24 and the second detection end 25. When the headset plug is inserted in position, the first detection end 24 is electrically connected to the second detection end 25 by using the membrane switch 26, and therefore, the connection may change the resistance value between the first detection end 24 and the second detection end 25. The change of the resistance value may be converted into a current signal or a voltage signal. The detection circuit 40 can identify the current signal or the voltage signal generated by the change of the resistance value, and thereby determine that the headset plug is inserted in position; alternatively, after the first detection end 24 is electrically connected to the second detection end 25 by using the membrane switch 26, a voltage that originally exists between the first detection end 24 and the second detection end 25 changes accordingly, and therefore, the detection circuit 40 detects the voltage change and thereby identifies that the headset plug is inserted in position. The variable electrical characteristic mentioned in this embodiment may have multiple different manifestations, and a specific implementation of the variable electrical characteristic is not intended to limit the present disclosure.

FIG. 2 shows two second detection ends 25, which are located at two joints of the side wall 21 and the bottom part 22 respectively. Actually, a quantity of the second detection ends 25 may be only one or may be more than three disposed at different positions on the side wall 21 and/or at the bottom part 22, which is not limited in this embodiment. A shape of the membrane switch 26 may be diversified, and is not limited to an arc shape. The membrane switch 26 may be not electrically connected to the first detection end 24 when the headset plug is not inserted in position, and when the headset plug is inserted in position, may generate elastic deformation and be electrically connected to the first detection end 24, thereby implementing a turn-on or turn-off function under an external force effect. Therefore, in the foregoing cases, a technical purpose of this embodiment of the present invention can be achieved in any case.

In an implementation, the clamping component 23 is further configured to transmit a signal from the headset jack 20 to the headset plug, where the signal may an audio-left channel signal or an audio-right channel signal. The clamping component 23 may also be configured for grounding or configured to transmit a microphone signal of the headset to the headset jack 20. That is, the clamping component 23 can implement a function of any pin in the existing contacts L, R, M, and GND. For example, at least one of the first elastomer 231 and the second elastomer 232 may be an L contact (or pin), a GND contact, an R contact, or an M contact, and the other elastomer can implement the same function or may be not any contact. Using FIG. 2 as an example, the first elastomer 231 is an L contact and is configured to transmit an audio-left channel signal from the headset jack 20 to the headset plug, and the second elastomer 232 may have the same function as that of the first elastomer 231; or the second elastomer 232 shown in FIG. 2 is only a Dummy end, where the Dummy end is not configured to transmit a signal but is configured to implement only a headset clamping function. Optionally, when being an R contact, the first elastomer 231 is configured to transmit an audio-right channel signal from the headset jack 20 to the headset plug. When being a GND contact, the first elastomer 231 is configured to implement grounding and transmit a ground signal to the headset plug.

The foregoing technical solution is applicable to various headsets, such as a tip-ring-sleeve headset, an LRGM headset, and an LRMG headset. No matter how the four contacts of L, R, G, and M of the headset and the headset jack are sorted, the mechanical structure in this solution is applicable, and is simple to implement, without needing software or hardware designed complicatedly. For example, an anti-jitter circuit and a threshold detection circuit in an existing detection circuit can be simplified significantly.

The foregoing are merely several embodiments of the present invention. A person skilled in the art may make various modifications and variations to the present disclosure without departing from the spirit and scope of the present disclosure. For example, a specific shape or structure of each part in an accompanying drawing in the embodiments of the present invention may be adjusted according to an actual application scenario.

What is claimed is:

1. A headset jack, comprising:

a side wall;

a bottom part;

a clamping component on the side wall;

a first detection end at the bottom part;

a second detection end on the side wall or at the bottom part; and a membrane switch electrically connected to the second detection end, wherein the clamping component is configured to clamp a headset plug when the headset plug is inserted into the headset jack, wherein when the headset plug is not inserted in position, the membrane switch is electrically isolated from the first detection end, and an electrical characteristic between the first detection end and the second detection end is a first electrical characteristic, wherein the membrane switch is configured to generate elastic deformation under a pressure of the headset plug when the headset plug is inserted in position and be electrically connected to the first detection end, so as to electrically connect the first detection end to the second detection end, and change the electrical characteristic between the first detection end and the second detection end to a second electrical characteristic, and wherein the second electrical characteristic is used to generate an electrical signal to reflect that the headset plug is inserted into the headset jack in position;

wherein the membrane switch comprises an elastically deformable part and a conductive connector, the conductive connector is electrically connected to the second detection end by a conducting wire or an electrical connection component, the elastically deformable part generates elastic deformation under the pressure of the headset plug to cause the conductive connector to be electrically connected to the first detection end, the elastically deformable part comprises an insulation material, and the conducting wire or the electrical connection component is buried in the elastically deformable part.

2. The headset jack according to claim 1, wherein the clamping component comprises multiple elastic elements configured to clamp the headset plug.

3. The headset jack according to claim 1, wherein the clamping component is further configured to transmit a signal from the headset jack to the headset plug.

4. The headset jack according to claim 3, wherein the signal is an audio-left channel signal or an audio-right channel signal.

5. The headset jack according to claim 1, wherein the first electrical characteristic is electrical isolation, and wherein the second electrical characteristic is electrical connection.

6. An electronic device, comprising:

a headset jack; and a detection circuit, wherein the headset jack comprises a side wall, a bottom part, a clamping component on the side wall, a first detection end at the bottom part, a second detection end on the side wall or at the bottom part, and a membrane switch electrically connected to the second detection end, wherein the clamping component is configured to clamp a headset plug when the headset plug is inserted into the headset jack, wherein when the headset plug is not inserted in position, the membrane switch is electrically isolated from the first detection end, and an electrical characteristic between the first detection end and the second detection end is a first electrical characteristic, wherein the membrane switch is configured to generate elastic deformation under a pressure of the headset plug when the headset plug is inserted in position and be electrically connected to the first detection end, so as to electrically connect the first detection end to the second detection end, and change the electrical characteristic between the first detection end and the second detection end to a second electrical characteristic, wherein the second electrical characteristic is used to generate an electrical signal to reflect that the headset plug is inserted into the headset jack in position, and wherein the detection circuit is configured to detect the electrical signal to identify that a headset plug is inserted into the headset jack in position;

wherein the membrane switch comprises an elastically deformable part and a conductive connector, the conductive connector is electrically connected to the second detection end by a conducting wire or an electrical connection component, the elastically deformable part generates elastic deformation under the pressure of the headset plug to cause the conductive connector to be electrically connected to the first detection end, the elastically deformable part comprises an insulation material, and the conducting wire or the electrical connection component is buried in the elastically deformable part.

7. The electronic device according to claim 6, wherein the clamping component is further configured to transmit a signal from the headset jack to the headset plug.

8. The electronic device according to claim 7, wherein the signal is an audio-left channel signal or an audio-right channel signal.

9. The electronic device according to claim 6, wherein the first electrical characteristic is electrical isolation, and wherein the second electrical characteristic is electrical connection.

* * * * *